US012752147B2

(12) United States Patent
Svenberg

(10) Patent No.: US 12,752,147 B2
(45) Date of Patent: Oct. 6, 2026

(54) WEIGHT APPARATUS INCLUDING WEIGHT ADJUSTMENT ARRANGEMENT

(71) Applicant: Personality Gym AB, Huskvarna (SE)

(72) Inventor: Tomas Svenberg, Huskvarna (SE)

(73) Assignee: Personality Gym AB, Huskvarna (SE)

( * ) Notice: Subject to any disclaimer, the term of this patent is extended or adjusted under 35 U.S.C. 154(b) by 0 days.

(21) Appl. No.: 19/018,348

(22) Filed: Jan. 13, 2025

(65) Prior Publication Data

US 2025/0144464 A1 May 8, 2025

Related U.S. Application Data

(60) Continuation of application No. 18/429,548, filed on Feb. 1, 2024, now Pat. No. 12,226,663, which is a continuation of application No. 18/127,146, filed on Mar. 28, 2023, now Pat. No. 11,918,842, which is a continuation of application No. 17/840,972, filed on Jun. 15, 2022, now Pat. No. 11,642,565, which is a continuation of application No. 16/992,706, filed on Aug. 13, 2020, now Pat. No. 11,389,688, which is a continuation of application No. 16/265,749, filed on Feb. 1, 2019, now Pat. No. 10,773,118, which is a continuation of application No. 16/124,228, filed on Sep. 7, 2018, now Pat. No. 10,232,216, which is a continuation of application No. 15/959,233, filed on Apr. 22, 2018, now Pat. No. 10,092,790, which is a continuation of application No. 15/361,395, filed on (Continued)

(51) Int. Cl.

| | |
|---|---|
| ***A63B 21/075*** | (2006.01) |
| ***A63B 21/00*** | (2006.01) |
| ***A63B 21/072*** | (2006.01) |
| *A63B 71/00* | (2006.01) |
| *A63B 71/06* | (2006.01) |

(52) U.S. Cl.

CPC ..... *A63B 21/075* (2013.01); *A63B 21/00065* (2013.01); *A63B 21/00069* (2013.01); *A63B 21/0726* (2013.01); *A63B 21/0728* (2013.01); *A63B 21/00072* (2013.01); *A63B 21/072* (2013.01); *A63B 2071/0081* (2013.01); *A63B 2071/0694* (2013.01)

(58) Field of Classification Search

CPC ..... A63B 21/00065; A63B 21/00069; A63B 21/00072; A63B 21/072; A63B 21/0726; A63B 21/0728; A63B 21/075; A63B 2071/0081; A63B 2071/0694

See application file for complete search history.

(56) References Cited

U.S. PATENT DOCUMENTS 6,416,446 B1 * 7/2002 Krull ..... A63B 21/0628 482/107
6,500,101 B1 * 12/2002 Chen ..... A63B 21/072 482/107

(Continued)

*Primary Examiner* — Joshua Lee
(74) *Attorney, Agent, or Firm* — Muncy, Geissler, Olds & Lowe, P.C.

(57) ABSTRACT

A weight apparatus includes a bar including a handle, an anchorage rotatably mounted to an end of the handle, the handle and the anchorage having an axially extending opening, a pinion gear rotatably mounted in the anchorage, a rod slidably disposed inside the axially extending opening and having a rack arranged to be moved axially relative to the axially extending opening upon rotation of the pinion gear.

20 Claims, 12 Drawing Sheets

Related U.S. Application Data

Nov. 26, 2016, now Pat. No. 9,974,994, which is a division of application No. 14/306,422, filed on Jun. 17, 2014, now Pat. No. 9,616,271, which is a division of application No. 13/488,470, filed on Jun. 5, 2012, now Pat. No. 8,784,283.

(56) References Cited

U.S. PATENT DOCUMENTS 6,540,650 B1 * 4/2003 Krull ..... A63B 21/063 482/94
7,090,625 B2 * 8/2006 Chermack ..... A63B 21/075 482/107
7,137,932 B2 * 11/2006 Doudiet ..... A63B 21/075 482/107
7,172,536 B2 * 2/2007 Liu ..... A63B 21/075 482/93
7,588,520 B2 * 9/2009 Nalley ..... A63B 21/075 482/99
7,862,487 B2 * 1/2011 Olson ..... A63B 21/0728 482/98
8,529,415 B2 * 9/2013 Svenberg ..... A63B 21/0728 482/106
9,504,868 B2 * 11/2016 Liu ..... A63B 21/0726
2006/0025287 A1 * 2/2006 Chermack ..... A63B 21/075 482/107
2008/0146420 A1 * 6/2008 Chen ..... A63B 21/0728 482/108
2009/0197745 A1 * 8/2009 Olson ..... A63B 21/075 482/107
2009/0305852 A1 * 12/2009 Hoglund ..... A63B 21/075 482/107
2010/0323856 A1 * 12/2010 Svenberg ..... A63B 21/075 482/108
2011/0092345 A1 * 4/2011 Svenberg ..... A63B 21/063 482/107
2011/0245048 A1 * 10/2011 Nalley ..... A63B 21/0615 482/107
2012/0021877 A1 * 1/2012 Lundquist ..... A63B 21/0728 482/107
2012/0309597 A1 * 12/2012 Liu ..... A63B 21/00065 482/107

* cited by examiner

WEIGHT APPARATUS INCLUDING WEIGHT ADJUSTMENT ARRANGEMENT

BACKGROUND AND SUMMARY

The present application is a continuation of U.S. patent application Ser. No. 18/429,548, filed Feb. 1, 2024, which is a continuation of U.S. patent application Ser. No. 18/127,146, filed Mar. 28, 2023, now U.S. Pat. No. 11,918,842, issued Mar. 5, 2024, which is a continuation of U.S. patent application Ser. No. 17/840,972, filed Jun. 15, 2022, now U.S. Pat. No. 11,642,565, issued May 9, 2023, which is a continuation U.S. patent application Ser. No. 16/992,706, filed Aug. 13, 2020, now U.S. Pat. No. 11,389,688, which is a continuation of U.S. patent application Ser. No. 16/265,749, filed Feb. 1, 2019, now U.S. Pat. No. 10,773,118, issued Sep. 15, 2020, which is a continuation of U.S. patent application Ser. No. 16/124,228, filed Sep. 7, 2018, now U.S. Pat. No. 10,232,216, issued Mar. 19, 2019, which is a continuation of U.S. patent application Ser. No. 15/959,233, filed Apr. 22, 2018, now U.S. Pat. No. 10,092,790, issued Oct. 9, 2018, which is a continuation of U.S. patent application Ser. No. 15/361,395, filed Nov. 26, 2016, now U.S. Pat. No. 9,974,994, issued May 22, 2018, which is a divisional of U.S. patent application Ser. No. 14/306,422, filed Jun. 17, 2014, now U.S. Pat. No. 9,616,271, issued Apr. 11, 2017, which is divisional of U.S. application Ser. No. 13/488,470, filed Jun. 5, 2012, now U.S. Pat. No. 8,784,283, issued Jul. 22, 2014, all of which are incorporated by reference.

The present invention relates generally to weight apparatus and, more particularly, to weight apparatus comprising bars to which one or more weights can be attached.

U.S. patent application Ser. Nos. 12/744,965, 12/744,972, 12/744,975, and 13/412,457, which are incorporated by reference, describe weight apparatus to which a plurality of weights can be attached and by rotation of a handle of a bar of the apparatus so that rods protrude from ends of the bar and are adapted to selectively secure one or more weights to the bar. In these arrangements, the rods have an overall length of half of the bar, or less, which imposes limits on the number of additional weights that can be attached to the bar. It is desirable to provide an apparatus that facilitates attaching additional weights to a bar.

According to an aspect of the present invention, a weight apparatus comprises a bar comprising a handle, an anchorage rotatably mounted to an end of the handle, the handle and the anchorage having an axially extending opening, a pinion gear rotatably mounted in the anchorage, a rod slidably disposed inside the axially extending opening and having a rack arranged to be moved axially relative to the axially extending opening upon rotation of the pinion gear.

BRIEF DESCRIPTION OF THE DRAWINGS

The features and advantages of the present invention are well understood by reading the following detailed description in conjunction with the drawings in which like numerals indicate similar elements and in which.

DETAILED DESCRIPTION

Figure 1:
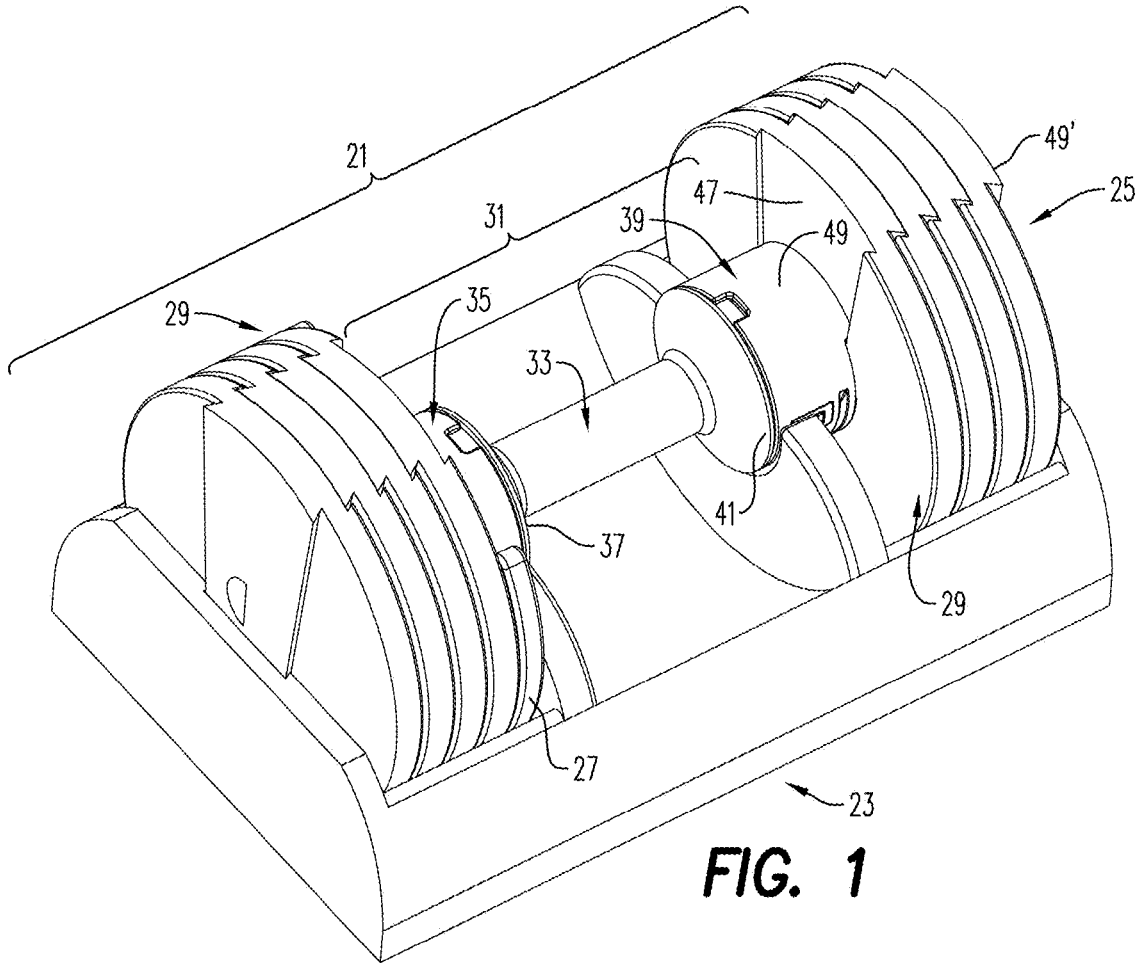
FIG. 1 is a perspective view of a weight apparatus according to an aspect of the present invention.

A weight apparatus 21 according to an aspect of the present invention is shown in FIG. 1. The apparatus 21 ordinarily includes a base 23 (a portion of which is seen by itself in FIG. 2) and a dumbbell 25. The apparatus 21 may comprise a barbell (not shown) instead of a dumbbell, however, the apparatus is particularly well-suited for use with a dumbbell. The present invention will, therefore, generally be described in connection with a dumbbell, however, it will be appreciated that the invention can pertain to barbells, as well.

The dumbbell 25 ordinarily comprises at least one and ordinarily a plurality of weight discs 27 and/or 29. Ordinarily, at least one weight disc 27 and/or 29 is provided at opposite ends of a bar 31 of the dumbbell 25. While the term "disc" is used to refer to the weights, it will be appreciated that the weights may have forms other than discs. An innermost weight disc 27 shall be referred to herein as an auxiliary weight disc and attaches to the bar 31 differently than the other weight discs 29, which are ordinarily all identical. FIG. 1 shows the dumbbell 25 with only one auxiliary weight disc 27, however, there are ordinarily two such discs disposed on opposite ends of the dumbbell.

The bar 31 comprises a handle 33 and an anchorage 35 rotatably mounted to an end 37 of the handle. Another anchorage 39, which may be substantially identical to the anchorage 35, is rotatably mounted to the other end 41 of the handle 33. For purposes of discussion, the invention will be primarily described in connection with the anchorage 35, it being understood that the discussion regarding the anchorage 35 can generally also apply to the anchorage 39, except where otherwise noted.

Figure 3:
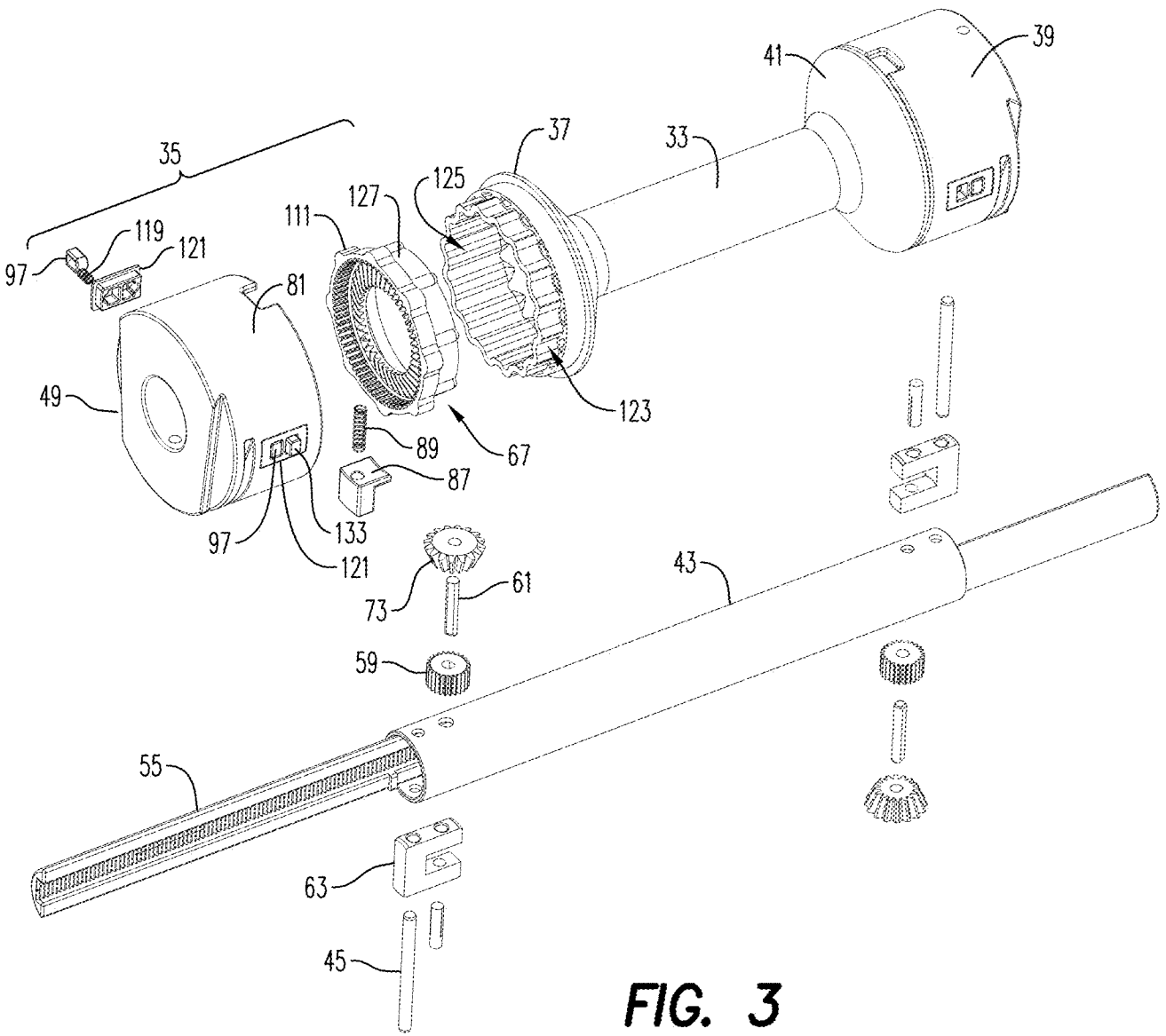
FIG. 3 is a perspective, exploded view of a bar of a weight apparatus according to an aspect of the present invention.
Figure 4:
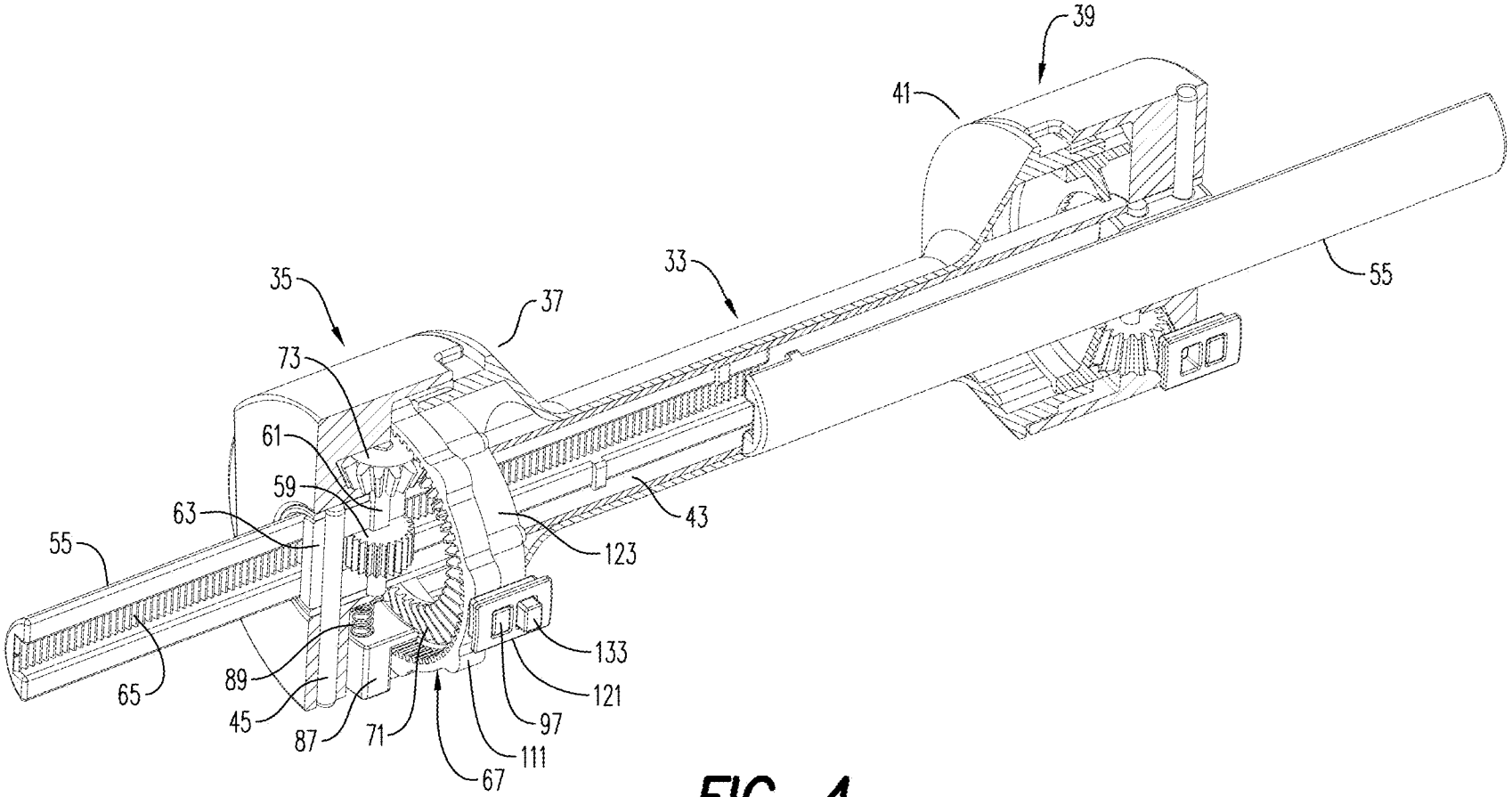
FIG. 4 is a perspective, partially cross-sectional view of a bar of a weight apparatus according to an aspect of the present invention.
Figure 5:
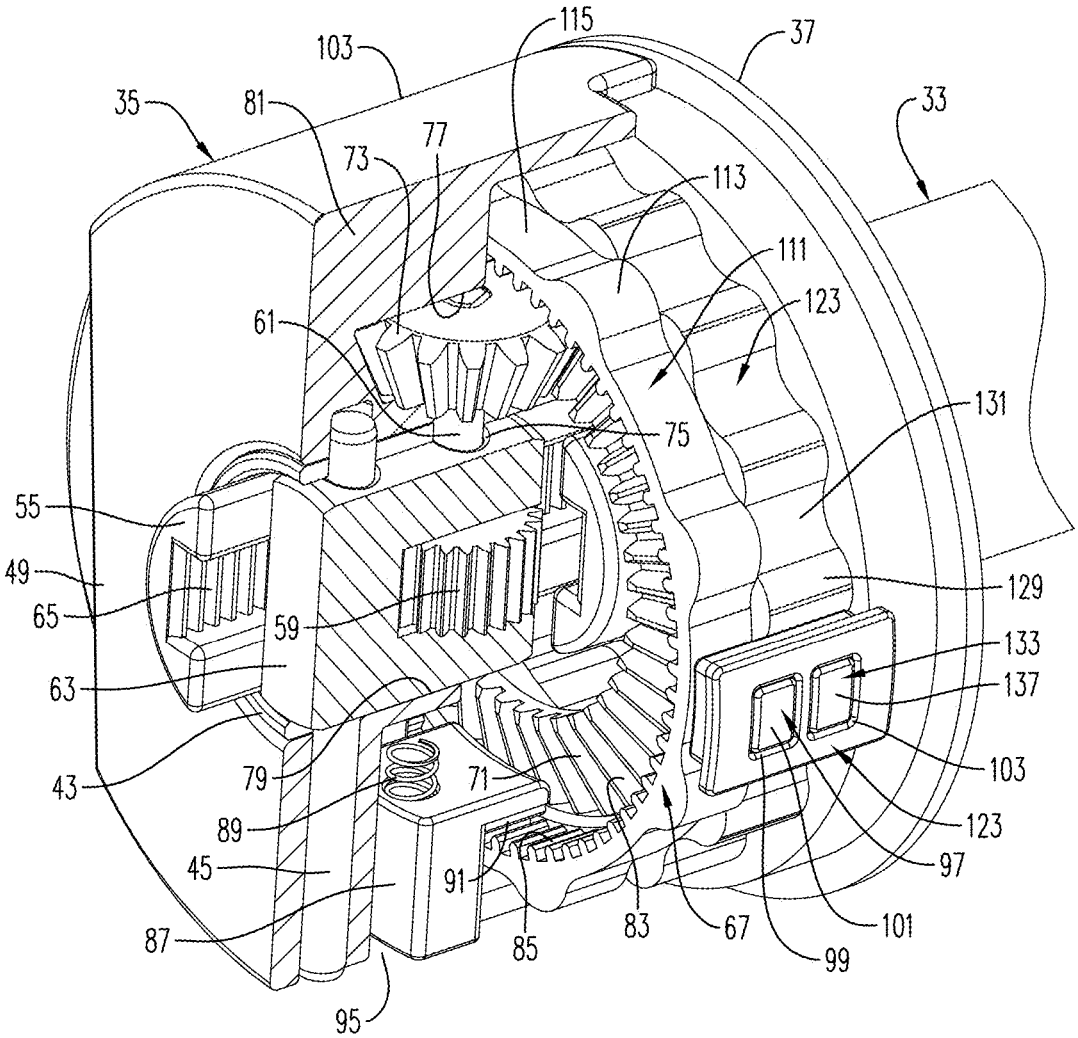
FIG. 5 is a perspective, partially cross-sectional view of a portion of an anchorage of a bar of a weight apparatus according to an aspect of the present invention.

As seen in FIGS. 3-5, the handle 33 and the anchorage 35 (and also the anchorage 39—not shown in FIG. 5) have an axially extending opening in which, ordinarily, a tube 43 is disposed. The tube 43 is non-rotatably attached to the anchorage 35 (and 39) by a pin 45. The attachment of the tube 43 to the anchorages 35 (and 39) by the pin 45 retains the anchorages axially relative to the handle 33.

As seen, for example, in FIG. 1, the weight discs 29 and the anchorages 35 and 39 each comprise respective components 47 and 49, respectively, of a joint that permits radial movement of and prevents axial movement of an attached weight disc relative to the anchorage. A preferred form of joint is a in the form of a V-shaped dovetail connection of the type disclosed in U.S. patents application Ser. Nos. 12/744,965, 12/744,972, 12/744,975, and 13/412,457, which are incorporated by reference. In the embodiments illustrated, the joint comprises a male V-shaped dovetail joint portion 49 on the anchorage 35 and a female V-shaped dovetail joint portion 47 (a portion of which is seen in FIG. 1) on the weight disc 29. The weight disc 29 is seated in a weight seat 51 of the base 23 with the female joint portion 47 facing upwardly and the bar 31 is lowered to a bar seat 53 so that the male joint portion 49 mates with the female joint portion. When the female and male joint components 47 and 49 are fully mated in this fashion, the weight disc 29 is radially movable relative to the anchorage 35 but not axially movable.

Figure 6:
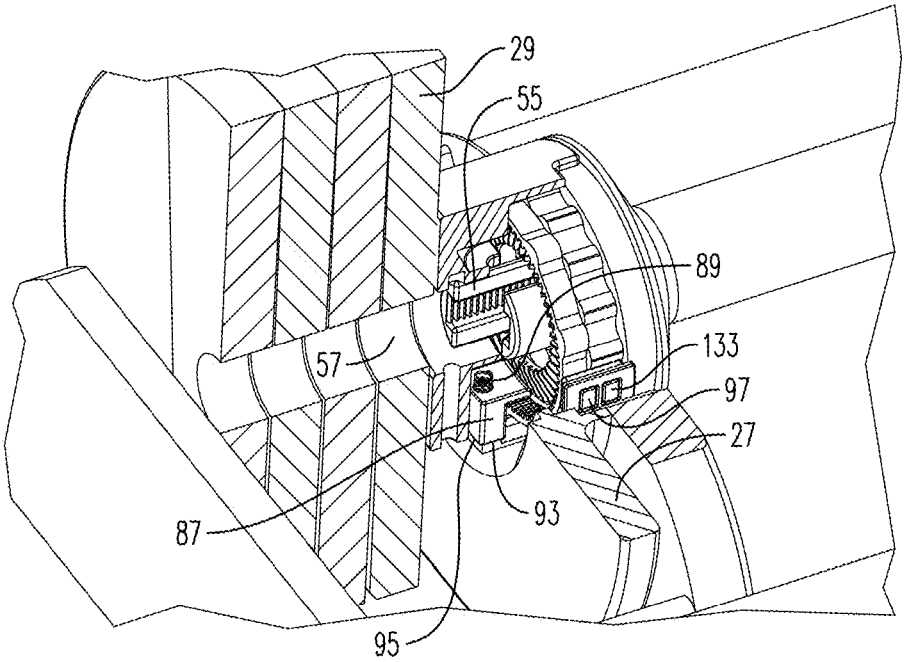
FIGS. 6-9 are perspective, partially cross-sectional views of a portion of a weight apparatus according to an aspect of the present invention showing rods of the bar of the weight apparatus at different positions relative to an anchorage of the bar and weight discs adjacent to that anchorage.
Figure 7:
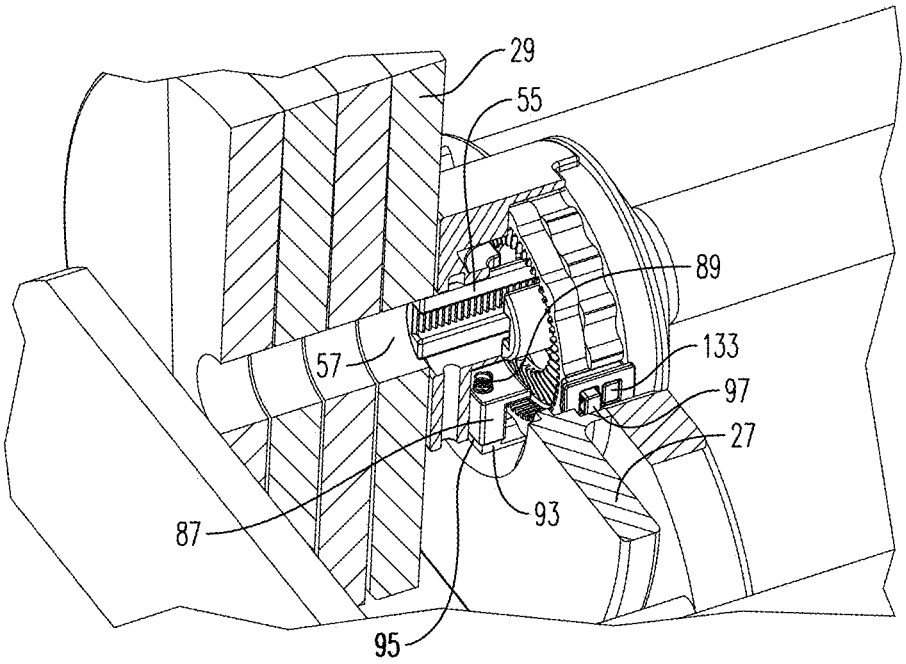
Figure 8:
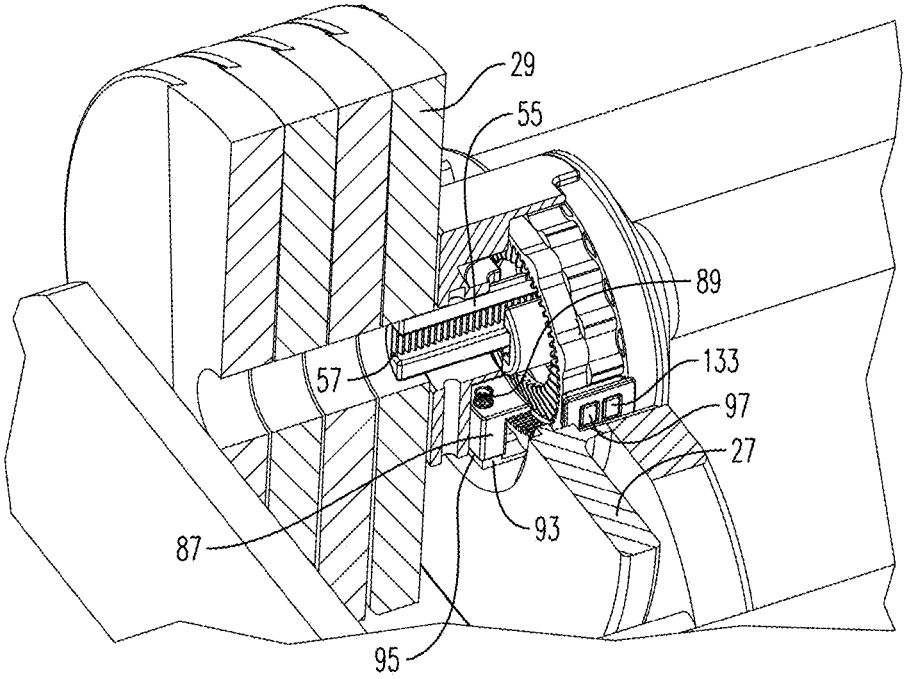
Figure 9:
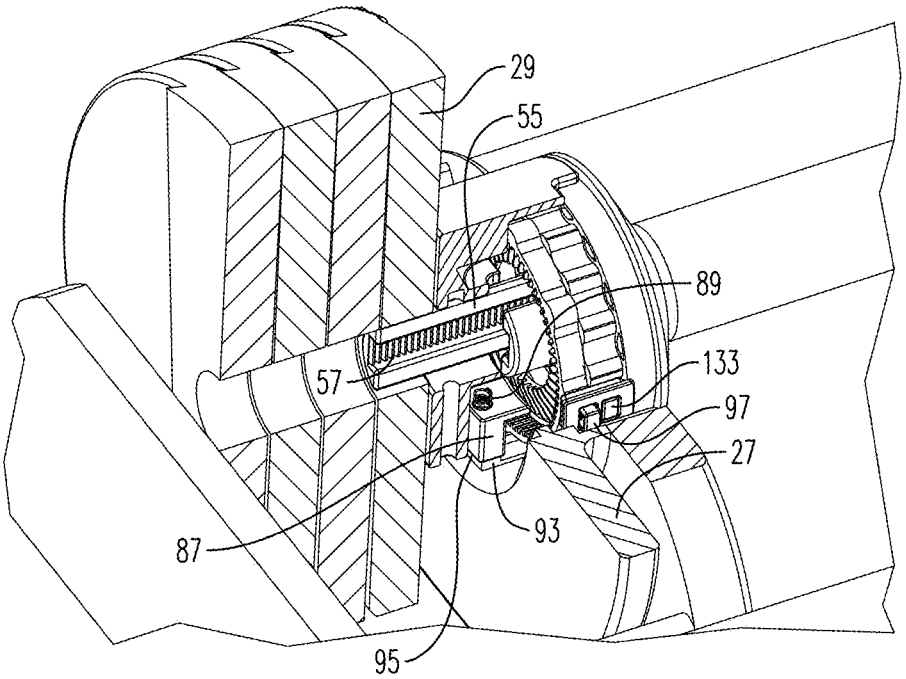
Figure 10:
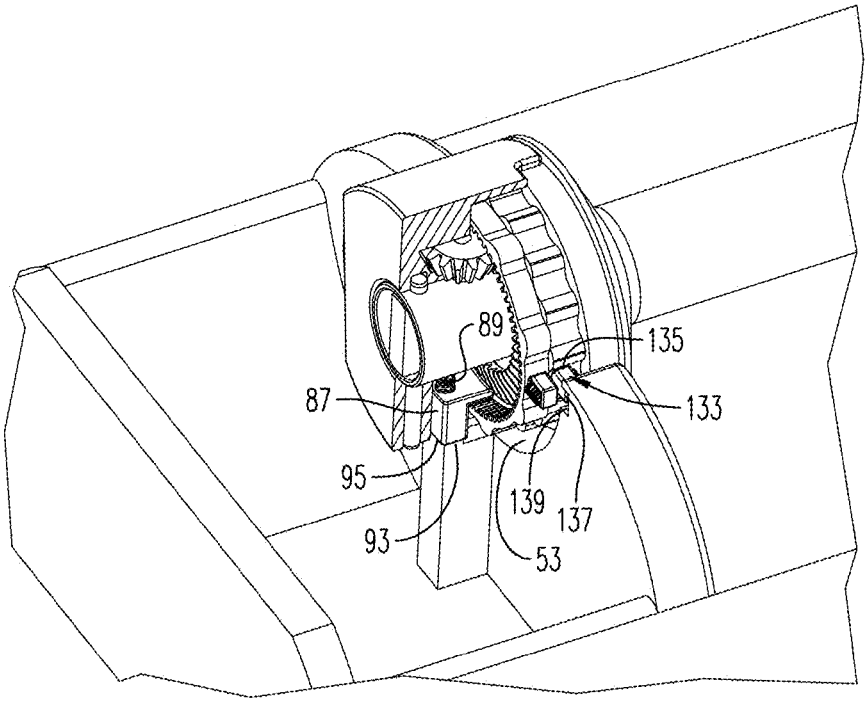
FIGS. 10-12 are perspective, partially cross-sectional views of a portion of a weight apparatus according to an aspect of the present invention showing operation of locking and indexing structures of the weight apparatus.

To attach the weight disc 29 to the anchorage 35 so that the weight disc is also not radially movable relative to the anchorage, as seen, for example, in FIGS. 6-9, the bar 31 is provided with an arrangement that causes rods 55 to extend from the anchorage into axial openings 57 of attached weight discs 29, thereby preventing radial movement of the weight discs. Ordinarily, a plurality of identical weight discs are positioned adjacent to each other on the weight seat 51 (FIG. 2) of the base 23. Each weight disc 29 has, on one side, a female V-shaped dovetail joint portion 47 and, on an opposite side, a male V-shaped dovetail joint portion 49' (FIG. 1) of the same general shape as the male V-shaped dovetail joint portion 49 on the anchorage 35. When seated in the weight seat 51 of the base 23, each of the weight discs 29 are not axially movable relative to each other (or to a bar 31 seated in the bar seat 53) but are radially movable relative to each other. As seen in FIGS. 6 and 7, when the rod 55 is disposed entirely inside of the anchorage 35, the weight discs 29 and the bar 31 are movable relative to each in a radial direction (for example, by lifting the bar 31 from the bar seat 53). However, when, as seen in FIGS. 8 and 9, the rod 55 extends into an axial opening 57 of a weight disc 29 adjacent to the anchorage 35, the weight disc is no longer radially movable relative to the bar 31 and, if the bar is lifted from the bar seat 53 of the base 23, the weight disc will be lifted with the bar. Additional weight discs can be attached in the same manner by continuing to move the bar 55 outward from the anchorage 35. A rod 55 ordinarily extends from each anchorage 35 and 39 so that an equal number of weight discs 29 are picked up on each end of the bar 31.

The rod 55 is caused to extend from or retract into the bar 31 by rotating the handle 33 relative to the anchorages 35 and 39. As seen, for example, in FIG. 5, a pinion gear 59 is non-rotatably mounted on an axle 61 and is rotatably mounted in a bearing or pinion house 63 in the tube 43. Such a pinion gear 59 is rotatably mounted in a pinion house at each end of the tube 43.

The rod 55 is slidably disposed inside the tube 43 and has a rack 65 arranged to be moved axially relative to the tube upon rotation of the pinion gear 59. When the tube 43 is circular in cross-section, the rod 55 ordinarily has the general cross-sectional shape of a segment of a circle, the circle having a diameter that is slightly less than the interior diameter of the tube 43, and the segment being approximately the thickness of the radius of the interior of the tube minus the one half the thickness of the pinion house 63. The tube 43 need not be circular in cross-section, and the rod 55 need not have the shape of a segment of a circle, however, these are conveniently manufactured shapes.

The rack 65 is ordinarily on the flat surface of the segment or, more typically, recessed into the flat surface of the segment in a channel having a width at least as great as a thickness of the pinion gear 59. Two identical rods 55 are disposed on opposite sides of the pinion house 63 in the tube 43 with their respective racks 65 in engagement with the pinion gear 59. Rotation of the pinion gear 59 causes the rods 55 to move in opposite directions. The rods 55 are ordinarily slightly shorter than the tube 43 so that they can each be fully retracted inside the tube but are sufficiently long so that the rack 65 of each rod is always engaged with teeth of at least one of the pinion gears 59. By providing two identical rods 55 that are both nearly as long as the tube 43, it is possible to attach more weights to the dumbbell 25 (or barbell) than would be possible in arrangements such as those shown in U.S. patent application Ser. Nos. 12/744,965, 12/744,972, and 12/744,975 where rods are only half as long as the dumbbell, or shorter, and, thus, cannot extend as far out from the anchorage.

A gear drive arrangement is provided for rotating the pinion gear 59 upon rotation of the handle 33 relative to the anchorage 35. Ordinarily, the gear drive arrangement is an angle gear drive arrangement such as a bevel gear, a face gear, or a worm gear drive arrangement. A bevel gear arrangement is shown in, e.g., FIGS. 3-5. As seen, for example, in FIG. 5, a gear housing 67 can be non-rotatably attached at an end 37 of the handle 33 (or may be formed integrally with the rest of the handle). The gear housing 67 comprises a first gear 71 of the bevel gear, and a second gear 73 is non-rotatably mounted on the axle 61. The axle 61 extends through holes 75 in the tube 43 and ordinarily abuts surfaces 77 and 79 in a body 81 of the anchorage 35.

Figure 11:
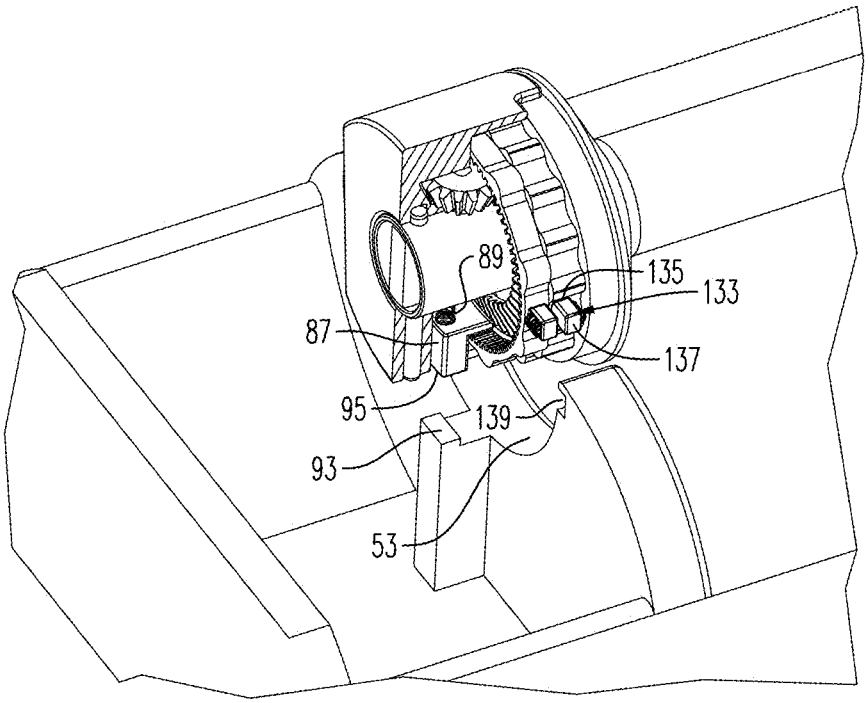
Figure 12:
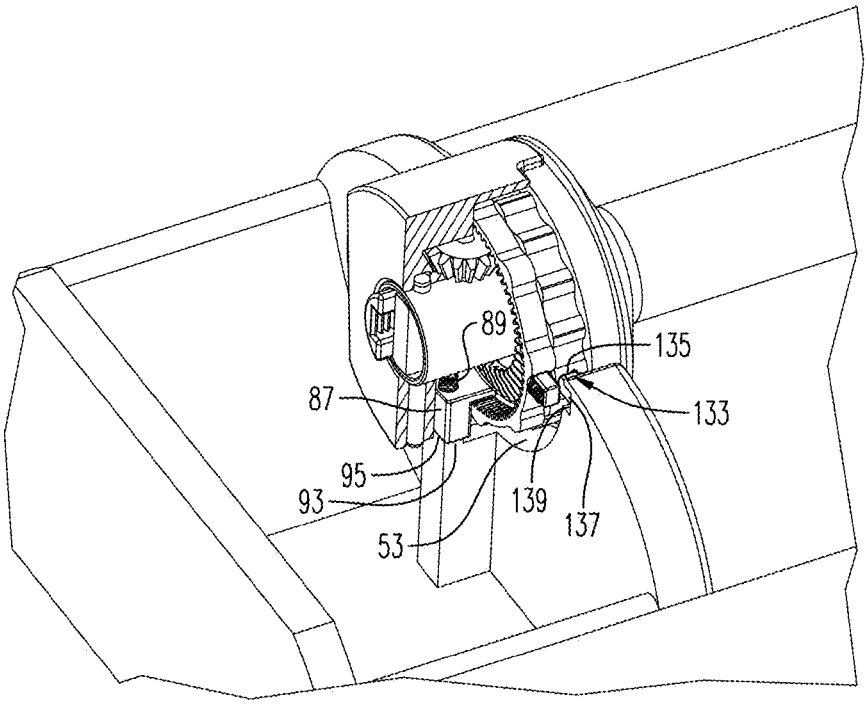

The gear 71 of the gear housing 67 can be recessed from an end of the gear housing inside an opening 83 that is provided with interior teeth 85. A spring loaded lock 87 having the general shape of a pin is mounted in the body 81 of the anchorage 35 and is movable against the force of a spring 89 to a first or radially inner position (seen in, e.g., FIGS. 5-10 and 12) in which teeth 91 (FIG. 5) on the lock are not engaged with the interior teeth 85 (FIG. 5) on the gear housing 67 so that the handle 33 is rotatable relative to the anchorage 35. The lock 87 is movable by the force of the spring 89 to a second or radially outer position (FIG. 11) in which the teeth 91 on the lock engage with the interior teeth 85 on the gear housing 67 so that the handle is non-rotatable relative to the anchorage. The base 23 can be provided with a protrusion 93 on the bar seat 53 that can extend through an opening 95 in the body 81 of the anchorage 35 to contact the lock 87 and compress the spring 89 to move the lock to the first position so that the teeth 85 and 91 disengage and the handle 33 can be rotated relative to the anchorage when the bar 31 is disposed in the bar seat. When the bar 31 is lifted from the bar seat 53 (FIG. 11), the protrusion 93 is removed from the opening 95, the spring 89 forces the lock 87 to the first position, and the teeth 85 and 91 engage to prevent rotation of the handle 33 relative to the anchorage 35. In this way, inadvertent withdrawal of the rods 55 into the tube 43, which might result in a weight disc 27 or 29 being dropped (or inadvertent extension of the rods from the tube) can be prevented when the bar 33 and one or more weight discs are lifted from the base 23.

Figure 19:
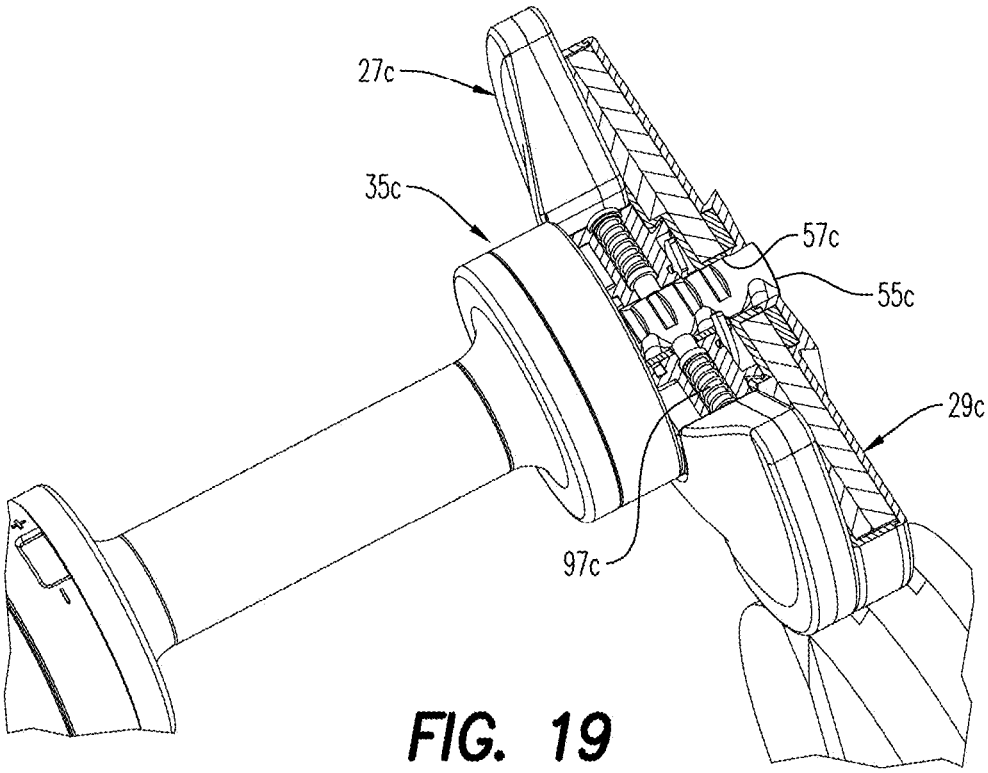
FIGS. 19 and 20 are perspective views of portions of an auxiliary weight disc and weight apparatus showing relative positions of a rod in an adjacent base weight disc when the auxiliary weight disc is connected to (FIG. 19) and not connected to (FIG. 20) the handle.
Figure 20:
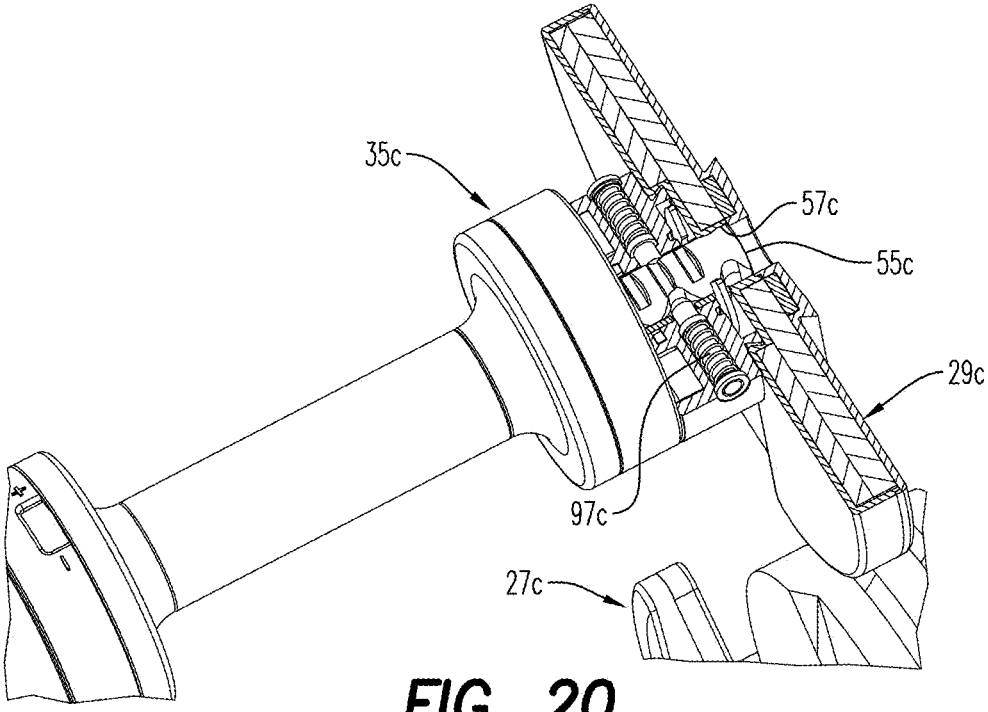

U.S. patent application Ser. No. 13/412,457, which is incorporated by reference, discloses a structure and method for attaching an auxiliary weight to a bar that can be adapted for use in connection with the present invention. That application discloses, and accompanying FIGS. 19 and 20 show, securing the auxiliary weight 27*c* around part of a circumference of an anchorage 35*c* by means of a lock comprising spring-loaded pins 97*c* that are moved radially outward by a cam surface formed on the rod 55*c* that is moved axially in and out of the anchorage.

While the construction of U.S. patent application Ser. No. 13/412,457 can be adapted for use in the present invention, such as by forming cam surfaces on the rods 55, a presently preferred structure uses a lock comprising at least one, ordinarily two, radially extending pins 97 that are adapted to extend through openings 99 in the body 81 of the anchorage 35 (or pin housing 121 as seen in FIG. 5, if provided). The radially extending pins 97 are movable relative to the anchorage 35 between an innermost position (FIGS. 5, 6, 8, and 10-12) in which an outer end 101 (FIG. 5) of the pin is disposed radially inside or even with an external surface 103 of the anchorage 35 (or pin housing 121) and an outermost position (FIGS. 7, 9, and 14-15) in which the outer end of the pin extends radially beyond the external surface of the anchorage.

Figure 13:
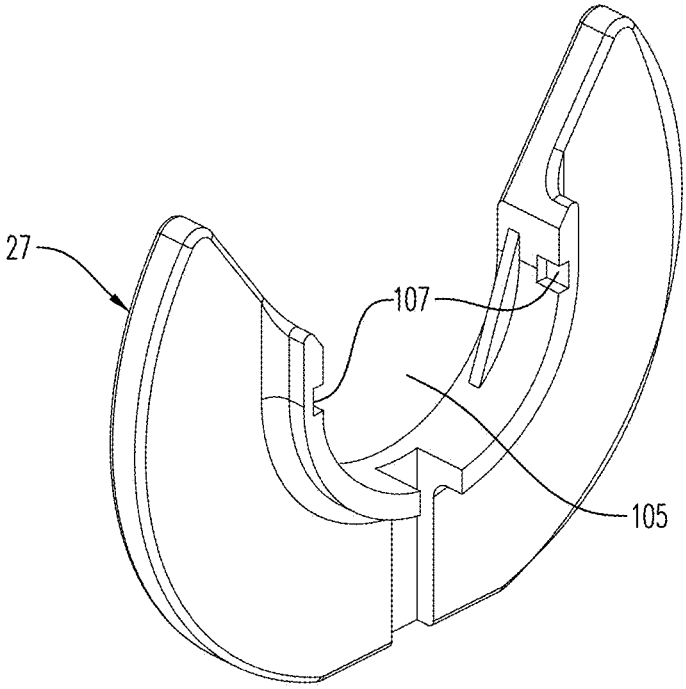
FIG. 13 is a perspective view of an auxiliary weight disc according to an aspect of the present invention.
Figure 14:
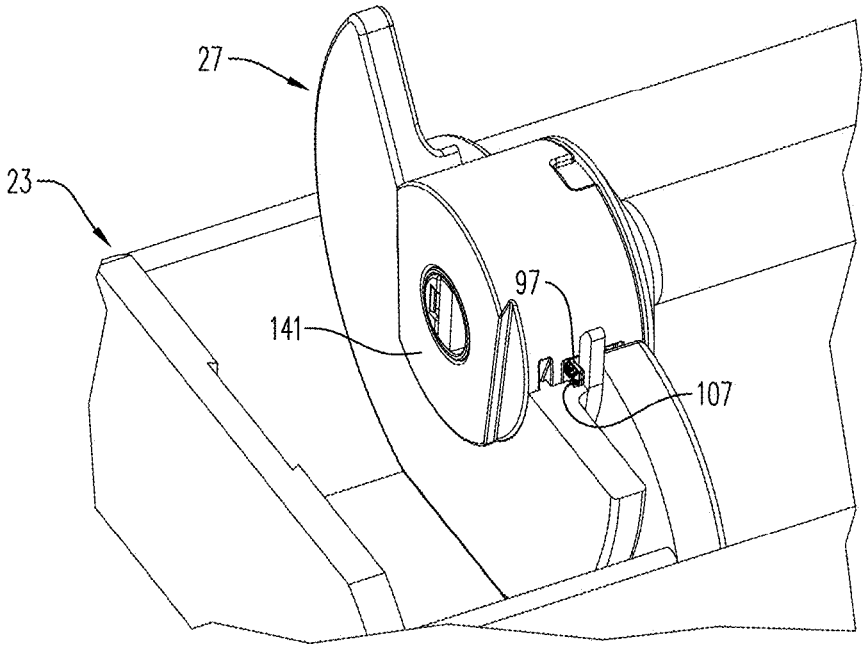
FIGS. 14-15 are perspective, partially cross-sectional views of a portion of a weight apparatus according to an aspect of the present invention showing operation of an arrangement for attaching an auxiliary weight to an anchorage of the weight apparatus.
Figure 15:
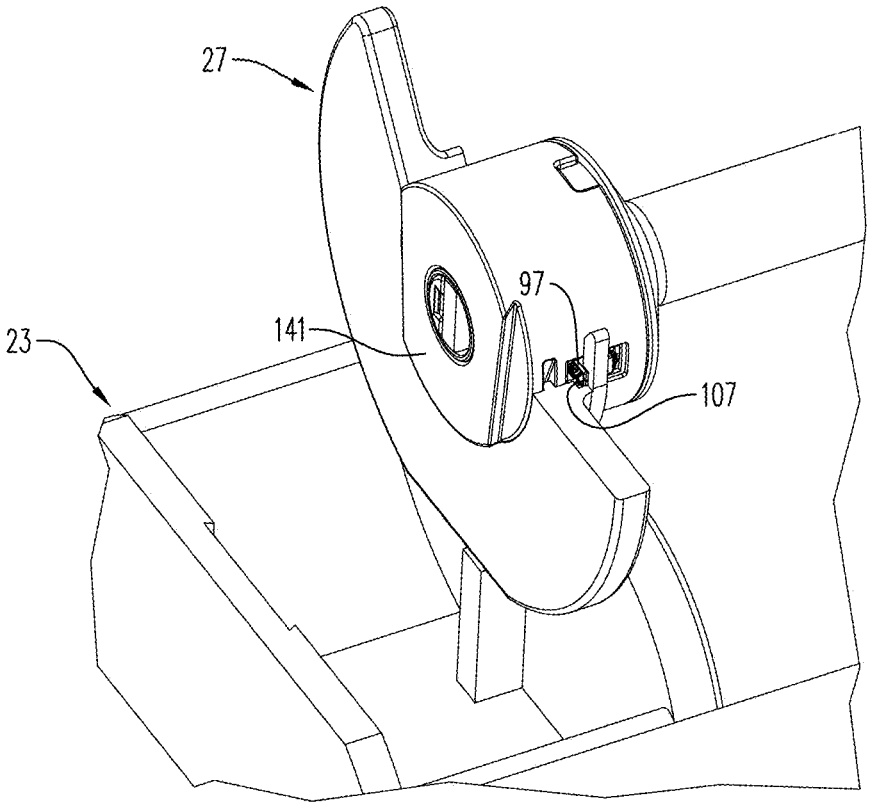

An auxiliary weight 27 (shown by itself in FIG. 13, and partially in cross-section in FIGS. 6-9 and 14-15) comprises a weight opening 105 in which the anchorage 35 is adapted to be received. The auxiliary weight 27 also comprises one or more radially extending pin openings 107 adapted to receive the outer end 101 of the pin 97 when the pin is in the outermost position to attach the weight to the anchorage.

As seen, for example, in FIG. 5, the exterior surface of the gear housing 67 of the handle 33 comprises a cam surface 111 having a first portion 113 with a first diameter and a second portion 115 with a second diameter smaller than the first diameter. The first diameter of the first portion 113 of the cam surface 111 is such that the first portion of the cam surface contacts the radially inner end of the pin 97 so that the pin is not movable inwardly of the outermost position when the handle 33 is rotated to a first position relative to the anchorage 35. In this position, the auxiliary weight 27 is fixed to the anchorage 35. The second diameter of the second portion 115 is such that, when the handle 33 is rotated to a second position relative to the anchorage 35, the inner end of the pin 77 is adapted to contact the second portion 115 of the cam surface so that the pin 97 is movable to the innermost position. A spring 119 or other resilient structure can be provided to urge the pin 97 to the innermost position.

The axial opening 57 of the weight disc 29 has an axially inner end (i.e., closest to the handle) and an axially outer end (i.e., furthest from the handle). Ordinarily, for the first weight disc 29 in contact with the anchorage 35, the pin 97 is disposed in the innermost position when an end of the rod 55 is between the axially inner end and the axially outer end. The pin 97 is ordinarily disposed in the outermost position when the end of the rod 55 is disposed at at least one of the axially inner end and the axially outer end of the axial opening 57. Except for the manner by which the pins are moved, this is the same as in U.S. patent application Ser. No. 13/412,457, the arrangement of which is shown in FIG. 19, where the end of the rod 55*c* is disposed at the axially outer end of the axial opening 57*c* in the weight 29*c* and the auxiliary weight 27*c* is connected to the anchorage 35*c* by the radially extending pins 97*c*. The auxiliary weight 27*c* would also be connected to the anchorage 35*c* if the end of the rod 55*c* were at the axially inner end of the axial opening 57*c*. As seen in FIG. 7, for example, the rod 55 is disposed at the axially inner end of the axial opening 57 of the first disc 29, not inside the axial opening 57 between the inner end and the outer end, and the pin 97 has been extended outwardly to the radially outermost position. As seen in FIG. 8, when the end of the rod 55 is disposed between the axially inner end of the axial opening and the axially outer end, the pin is retracted to the radially innermost position. Except for the manner in which the pins are moved, this is the same as in U.S. patent application Ser. No. 13/412,457, the arrangement of which is shown in FIG. 20, where the end of the rod 55*c* is disposed between the ends of the axial opening 57*c* in the weight 29*c* and the auxiliary weight 27*c* is not connected to the anchorage 35*c* by the radially retracted pins 97*c*. As seen in FIG. 9, when the end of the rod 55 is disposed at the axially outer end of the axial opening 57, the pin is again extended outwardly to the radially outermost position.

The pins 97 can be in the form of substantially rectangular boxes (seen in, e.g., FIG. 3) defining a chamber open on one side to receive approximately half of a spring 119 or other resilient structure so that opposite ends of the spring contact interior ends of the box. The other half of the spring 119 abuts on one (radially outer) end against an interior surface of the body of the anchorage 35 or, preferably, a surface of a pin housing 121. The pin housing 121 can have a radially extending structure (not shown) to assist in retaining the spring 119 in the pin and relative to the pin housing. When the first portion 113 of the cam surface 111 contacts the inner end of the pin 97, the pin is moved radially outward to the outermost position and the spring 119 is compressed against the inner surface of the pin housing. When the second portion 115 of the cam surface 111 is moved below the pin 97, the spring 97 presses at one end against the inner surface of the pin housing 121 and at the other end against an inner surface of the pin and moves the pin inwardly to the innermost position.

An indexing arrangement for assisting in proper positioning of the rods 55 relative to the handle 33 so that the rods will be in optimal positions for attaching weights 27 and/or 29 can be provided. The indexing arrangement can include an indexing cam surface 123 attached to the handle 33. In a presently preferred embodiment, the indexing cam surface 123 is an exterior surface of an end portion of the handle 33, where, as seen in FIG. 3, the end portion of the handle comprises an opening 125 for receiving a portion 127 of the gear housing. The opening 125 in the end of the handle 33 and the gear housing portion 127 can be provided with grooves/ridges for preventing rotation of the gear housing 67 relative to the handle 33 when the gear housing portion is received in the opening.

As seen, for example, in FIG. 5, the indexing cam surface 123 has a first portion 129 with a first diameter and a second portion 131 with a second diameter smaller than the first diameter. A spring loaded, radially extending indexing pin 133 is movably attached to the anchorage 35 and movable between an innermost position (seen in, e.g., FIGS. 4-11) in which an innermost end 135 (e.g., FIGS. 10-11) of the indexing pin 133 contacts the second portion 131 of the indexing cam surface 123 when the handle 33 is rotated to an indexing position relative to the anchorage 35 and an outermost position (FIG. 12) in which the innermost end of the indexing pin contacts the first portion 129 of the indexing cam surface when the handle is rotated to a non-indexing position relative to the anchorage.

The indexing pin 133 can be spring loaded by a spring (not shown) or other resilient structure in a chamber of the pin in substantially the same manner as the pins 97 for the auxiliary weight 27, with the spring held in place by a protrusion (not shown) on the pin housing 121. It will be appreciated that the structures of the pins 97 and 133 can be substantially identical and that the description of the operation of the pin 97 applies equally to the manner of operation of the pin 133. The pin 133 and spring are arranged such that movement of the handle 33 relative to the anchorage 35 from the indexing position to the non-indexing position is against a force of the spring.

The indexing cam surface 123 will ordinarily comprise a plurality of first portions 129 and an equal plurality of second portions 131. When the handle 33 is rotated relative to the anchorage 35 to an indexing position, i.e., the innermost end 135 of the indexing pin 133 contacts a second portion 131, the rods 55 will be properly positioned for attaching anywhere from zero to whatever the maximum number of weight discs 29 is for the particular weight apparatus 21, and the auxiliary weight pins 97 will be properly positioned for attaching or not attaching the auxiliary weights 27.

Figure 2:
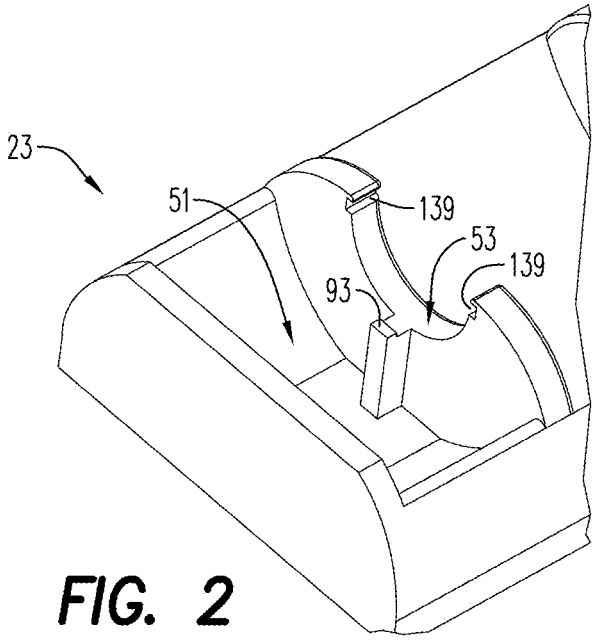
FIG. 2 is a perspective view of a portion of a base for a weight apparatus according to an aspect of the present invention.

When the handle 33 is rotated relative to the anchorage 35 to a non-indexing position, i.e., the innermost end 135 of the indexing pin 133 contacts a first portion 129, the rods 55 may not be optimally positioned for attaching weight discs 29 and the auxiliary weight pins 97 may not be optimally positioned for attaching or not attaching the auxiliary weights 27. In the non-indexing position, the outermost end 137 of the indexing pin 133 extends beyond the external surface 103 of the anchorage 35. As seen in FIG. 2, the bar seat 53 on the base 23 includes one or more recesses 139. Ordinarily, the handle 33 can only be turned relative to the anchorage 35 while the anchorage is received in the bar seat 53 and the lock 87 is released. If the handle 33 is turned relative to the anchorage 35 to a non-indexing position, the outermost ends 137 of the indexing pins 133 will be received in the recesses 139 of the bar seat 53 on the base 23, and it will not be possible to lift the bar from the base.

Ordinarily, the indexing cam surface 123 will be configured to have twice as many first and second portions 129 and 131 as the cam surface 111 for contacting the pins 97 for the auxiliary weights 27 on the exterior surface 109 of the gear housing 67. In this way, for each additional weight disc 29 that the rods 55 attach to the bar 31, the rods can be indexed in either of two positions. In a first one of the positions in which, ordinarily, the rods 55 extend only about half of the way through the axial openings 57 of respective ones of the weight discs 29, and the position of the cam surface 111 will be such that the auxiliary weight disc pins 97 will not extend beyond the exterior surface 103 of the anchorage 35 and the auxiliary weight disc 27 will not be attached to the anchorage. In a second one of the positions, the rods 55 will ordinarily extend fully into but not beyond the axial openings 57 of respective ones of the weight discs 29, and the position of the cam surface 111 will be such that the auxiliary weight disc pins 97 extend beyond the exterior surface 103 of the anchorage 35 and are received in the openings 107 in the auxiliary weight disc and the auxiliary weight disc will be attached to the anchorage. Usually, the auxiliary weight disc 27 will be half the weight of the weight discs 29 so that a user can incrementally increase the weight to be lifted by half the weight of the weight discs 29, rather than have to increase the weight by the entire weight of the larger weight disc. The auxiliary weight disc 27 can be attached to the anchorage 35 before the rods 55 extend axially out of the end of the tube 43, i.e., before any weight disc 29 is attached to the bar 31.

Figure 16:
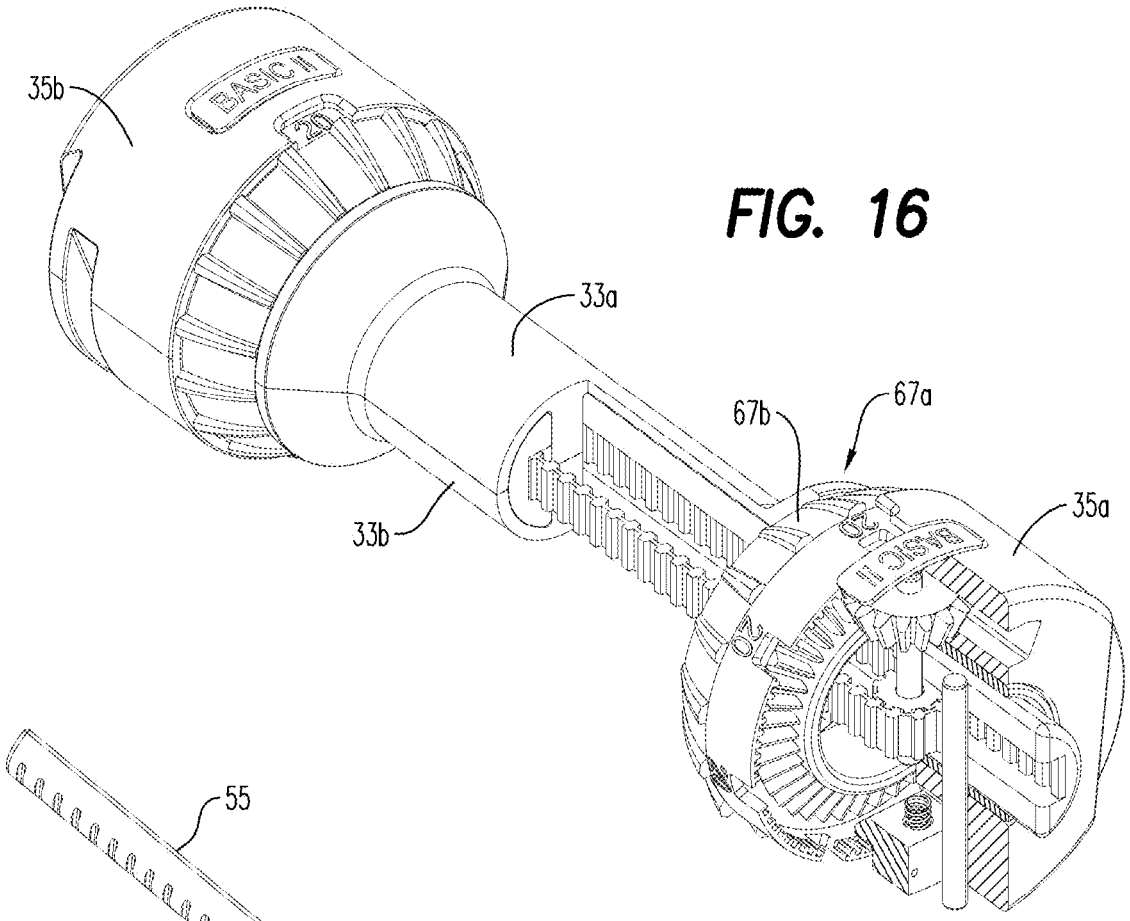
FIG. 16 is a perspective, partially cross-sectional view of a bar of a weight apparatus according to another aspect of the present invention.

Components of the weight apparatus can be made in a variety of suitable ways, and from a variety of suitable materials. As seen in FIG. 16, it may be convenient in some circumstances to make the handle 33 from two halves 33*a* and 33*b* having facing surfaces joined together along a plane extending along a longitudinal axis of the handle. While the embodiment of FIG. 16 can have an entire handle that rotates relative to the anchorages 35*a* and 35*b* to move the rods 55, the rods may instead be moved by rotating only an end of the handle in the form of a separate ring 67*a* that can be provided by just one of the anchorages 35*a* or 35*b*, or, if preferred, by both of the anchorages. The rest of the handle may be non-rotatable relative to the anchorages 35*a* and 35*b*. Where a rotatable ring 67*a* is provided, a variety of suitable gripping structures 67*b* can be provided on the exterior surface of the ring to facilitate gripping and turning of the ring.

Figure 17:
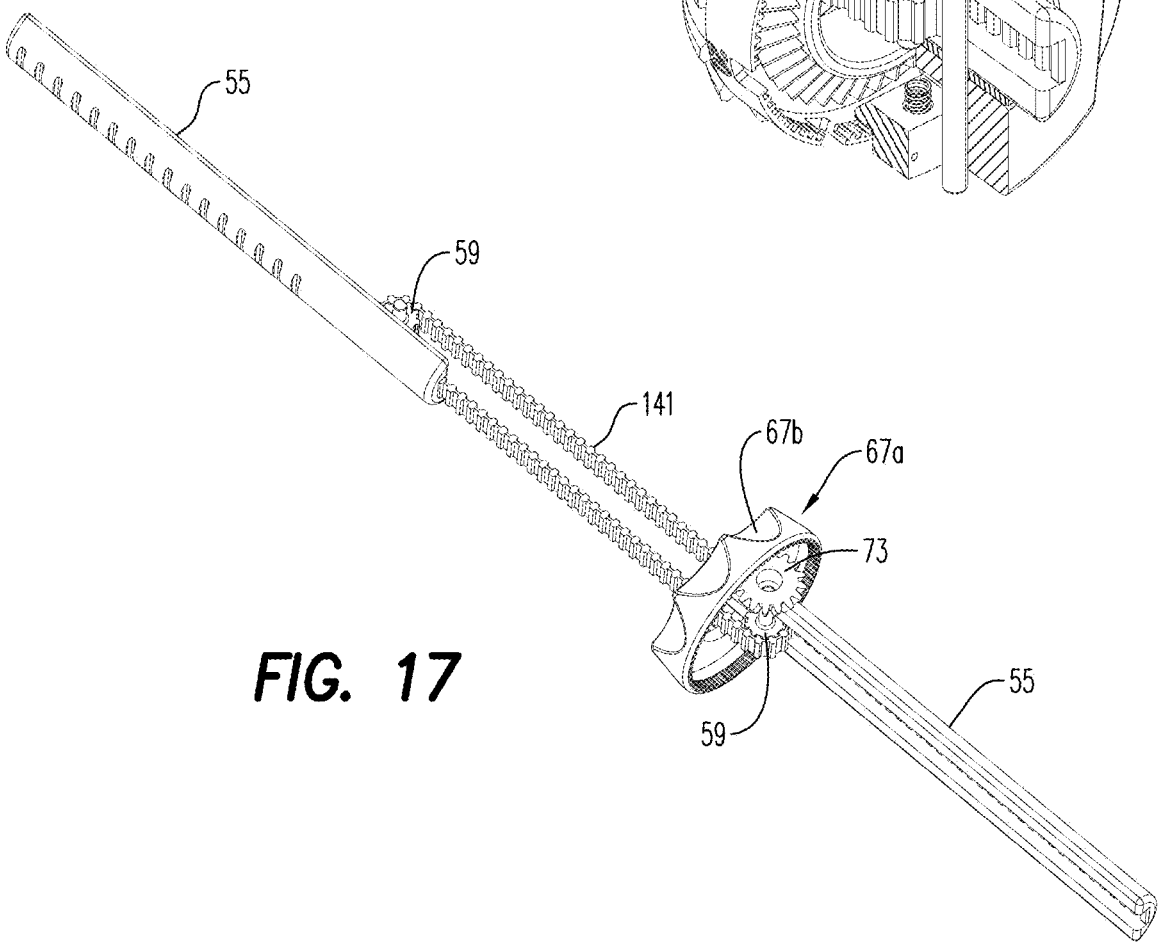
FIG. 17 is a perspective view of portions of the bar of the weight apparatus of FIG. 16.

In the embodiments thus far described, the pinion gear 59 engages directly with the rack 65 on the rods 55. However, as seen in FIGS. 16-17, it may be convenient in some circumstances to provide an intermediate belt 141 with inner and outer teeth for engaging with the pinion gear 59 and the rack 65. In the design of the bar 31 shown in FIGS. 3-5 and 10-12, each anchorage 35 will ordinarily, but not necessarily, have a gear drive arrangement such as a bevel gear arrangement for rotating the pinion gear 59 upon rotation of the handle 33 relative to the anchorage 35. Providing the belt 141 can facilitate using a single gear drive arrangement in one of the anchorages to drive pinion gears in both anchorages as seen in FIG. 17, such as might be useful when providing a ring 67*a* instead of a rotatable handle to move the rods 55, particularly relative to having one of the pinion gears not being driven other than by virtue of movement of the racks 65 on the rods 55.

Figure 18:
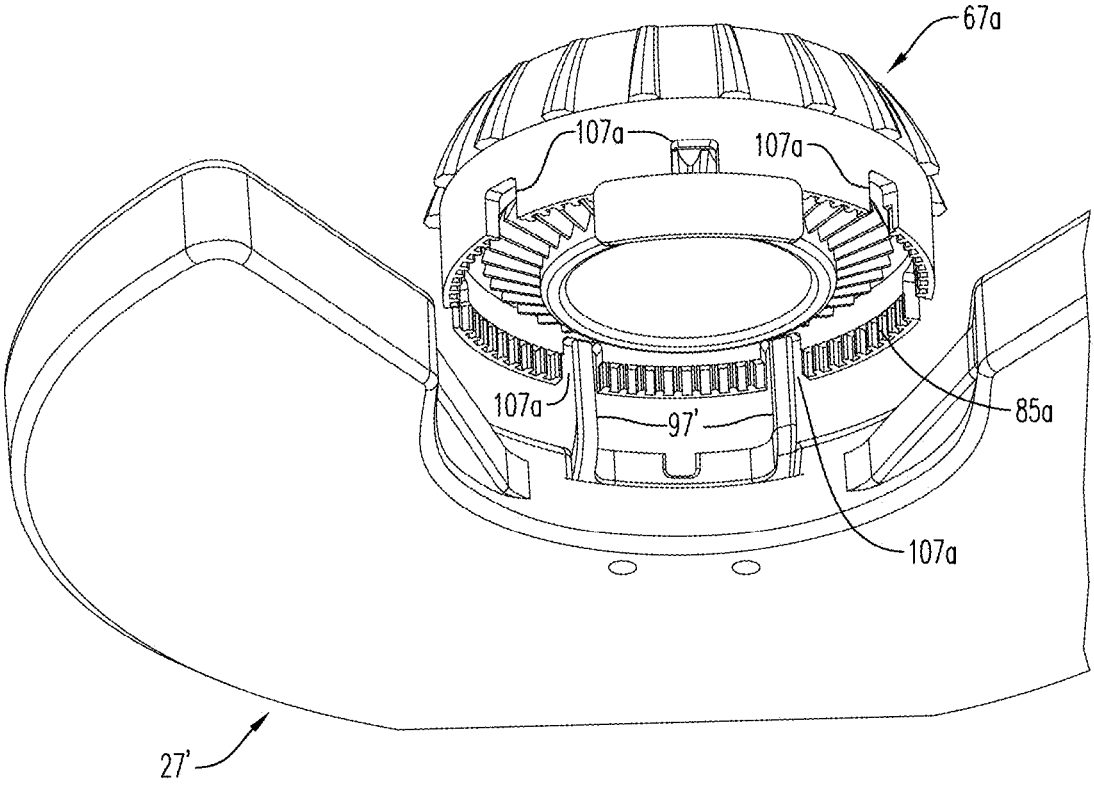
FIG. 18 is a perspective view of portions of an auxiliary weight disc and weight apparatus showing an arrangement for attaching the auxiliary weight disc to a handle according to another aspect of the present invention.

FIG. 18 shows an alternative form of auxiliary weight 27'. Instead of the auxiliary weight 27' being connected to a handle by a lock comprising spring loaded pins as in the embodiments described in connection with, e.g., FIGS. 12-15, the auxiliary weight is adapted to be connected to the handle via a lock comprising one or more prongs 97' on the auxiliary weight and one or more openings 107*a* in an axially extending portion of the gear housing 67*a*. In a position in which the auxiliary weight 27' is not attached to the handle, as seen in FIG. 18, the prongs 97' align with the openings 107*a* in the axially extending portion of the gear housing 67*a* on which the interior teeth 85*a* are provided. When the gear housing 67*a* is turned relative to the auxiliary weight 27' so that the prongs 97' are not aligned with the openings 107*a*, the auxiliary weight is attached to the handle. The openings 107*a* are ordinarily located so that the auxiliary weight 27' will be locked to the handle when the rod, e.g., the rod 55, is disposed at the axially innermost end or the axially outermost end of the axial opening 57 in one of the weight discs 29 attached to the handle, but not when the rod is disposed between the axially innermost or outermost ends of the axial opening(s) in the weight discs. In this way, the auxiliary weight 27' can be used to more incrementally increase the amount of weight on the bar between additional weight discs. The gear housing 67*a* can be of the ring type rotatable relative to the anchorages and the rest of the handle as shown in FIG. 16, of the type shown in FIGS. 3-12 that is rotatable relative to the anchorages but not the handle, or of a variety of other suitable forms. In addition, instead of a gear housing, the openings 107*a* may be formed in any suitable, axially extending annular portion of the handle that is rotatable relative to the anchorages, such as an indexing ring portion of the handle described in U.S. patent application Ser. Nos. 12/744,965, 12/744,972, 12/744,975, and 13/412,457.

In all embodiments, the auxiliary weight 27' is ordinarily locked to the handle when the rod, such as the rod 55, is disposed at one of the ends of the axially extending opening through one of the weight discs 29 attached to the handle, but is unlocked from the handle when the rod is disposed between the ends of the axially extending opening through one of the weight discs attached to the handle. This is illustrated by the arrangement described in U.S. patent application Ser. No. 13/412,457, which is shown in FIGS. 19 and 20, where, in FIG. 19, the end of the rod 55*c* is disposed at the end of the axial opening 57*c* in the weight 29*c* and the auxiliary weight 27*c* is connected to the anchorage 35*c* by the radially extending pins 97*c* and, in FIG. 20, where the end of the rod is disposed between the ends of the axial opening in the weight and the auxiliary weight is not connected to the anchorage by the radially retracted pins.

In the present application, the use of terms such as "including" is open-ended and is intended to have the same meaning as terms such as "comprising" and not preclude the presence of other structure, material, or acts. Similarly, though the use of terms such as "can" or "may" is intended to be open-ended and to reflect that structure, material, or acts are not necessary, the failure to use such terms is not intended to reflect that structure, material, or acts are essential. To the extent that structure, material, or acts are presently considered to be essential, they are identified as such.

While this invention has been illustrated and described in accordance with a preferred embodiment, it is recognized that variations and changes may be made therein without departing from the invention as set forth in the claims.

What is claimed is:

1. A weight apparatus, comprising:

a bar, the bar comprising a handle, a gear mounted proximate an end of the handle, an anchorage rotatably mounted to the end of the handle, the gear of the handle being disposed inside the anchorage, the handle and the anchorage having an axially extending opening, the anchorage comprising a radially extending opening extending radially from an outer surface of the anchorage toward the gear of the handle, a toothed member mounted in the anchorage and spring loaded via a spring relative to the anchorage so that the toothed member is movable between an extended position in which the toothed member engages with teeth of the gear of the handle and prevents rotation of the handle relative to the anchorage and a retracted position in which the toothed member is disengaged from the teeth of the gear of the handle and permits rotation of the handle relative to the anchorage, a rod slidably disposed inside the axially extending opening and arranged to be moved axially relative to the axially extending opening upon rotation of the handle relative to the anchorage; and a base, the base comprising a seat for the anchorage, and a projection adapted to extend into the radially extending opening when the anchorage is seated in the seat, wherein, when the projection extends into the radially extending opening, the projection moves the toothed member against a force of the spring to the retracted position and, when the projection is removed from the radially extending opening, the toothed member is moved under the force of the spring to the extended position.

2. The weight apparatus as set forth in claim 1, wherein the handle comprises a first and a second end, and the bar comprises a first and a second anchorage on the first and the second end of the handle, respectively.

3. The weight apparatus as set forth in claim 2, wherein the first and the second anchorage are substantially identical.

4. The weight apparatus as set forth in claim 2, wherein a tube is non-rotatably attached to the first and second anchorage in the axially extending opening, and a first and a second pinion gear corresponding to the first and the second anchorage are rotatably mounted in the tube, a first and a second rod being slidably disposed inside the tube, the first and the second rod having a first and a second rack, respectively, engaged with the first and second pinion gear, respectively, and a first and a second gear arrangement corresponding to the first and the second anchorage for rotating the first and the second pinion gears, respectively, upon rotation of the handle relative to the first and the second anchorage.

5. The weight apparatus as set forth in claim 1, comprising a pinion gear mounted in the anchorage and being rotated upon rotation of the handle relative to the anchorage.

6. The weight apparatus as set forth in claim 5, wherein the rod has a rack arranged to engage with the pinion gear so that rotation of the pinion gear moves the rod axially relative to the axially extending opening.

7. The weight apparatus as set forth in claim 5, comprising a gear drive arrangement for rotating the pinion gear upon rotation of the handle relative to the anchorage.

8. The weight apparatus as set forth in claim 7, wherein the gear drive arrangement is an angle gear drive arrangement.

9. The weight apparatus as set forth in claim 1, comprising a pin fixing a tube to the anchorage in the axially extending opening.

10. The weight apparatus as set forth in claim 1, comprising a weight, the weight and the anchorage comprising a joint that permits radial movement of and prevents axial movement of the weight relative to the anchorage.

11. The weight apparatus as set forth in claim 10, wherein the weight comprises an axial opening, and the rod is adapted to be axially moved into and removed from the axial opening, the weight being prevented from axially moving relative to an anchorage body of the anchorage when the rod is disposed in the axial opening of the weight.

12. The weight apparatus as set forth in claim 10, comprising at least one second weight, the weight and the at least one second weight comprising a joint that permits radial movement and prevents axial movement of the at least one second weight relative to the weight or another second weight.

13. The weight apparatus as set forth in claim 12, wherein the weight comprises a weight axial opening and the at least one second weight comprises a second weight axial opening, and the rod is adapted to be axially moved into and removed from the weight axial opening and the second weight axial opening, the weight and the at least one second weight being prevented from axially moving relative to an anchorage body of the anchorage when the rod is disposed in the weight axial opening and the second weight axial opening.

14. The weight apparatus as set forth in claim 12, wherein the weight and the at least one second weight are identical.

15. The weight apparatus as set forth in claim 10, wherein the joint is a dovetail joint.

16. The weight apparatus as set forth in claim 1, wherein the weight apparatus is a dumbbell.

17. The weight apparatus as set forth in claim 1, comprising at least one radially extending pin, the at least one radially extending pin being movable relative to the anchorage between an innermost position in which an outer end of the at least one radially extending pin is disposed radially inside or even with an external surface of the anchorage and an outermost position in which the outer end of the at least one radially extending pin extends radially beyond the external surface of the anchorage, and an auxiliary weight comprising a weight opening in which the anchorage is adapted to be received, the auxiliary weight comprising a radially extending pin opening adapted to receive the outer end of the at least one radially extending pin when the at least one radially extending pin is in the outermost position to attach the auxiliary weight to the anchorage.

18. The weight apparatus as set forth in claim 17, wherein the handle comprises a cam surface having a first portion with a first diameter and a second portion with a second diameter smaller than the first diameter, the first diameter of the first portion of the cam surface being such that the first portion of the cam surface contacts an inner end of the at least one radially extending pin so that the at least one radially extending pin is not movable inwardly of the outermost position when the handle is rotated to a first position relative to the anchorage, and the second diameter of the second portion being such that, when the handle is rotated to a second position relative to the anchorage, the inner end of the at least one radially extending pin is adapted to contact the second portion of the cam surface so that the at least one radially extending pin is movable to the innermost position.

19. The weight apparatus as set forth in claim 18, comprising an indexing arrangement including an indexing cam surface attached to the handle, the indexing cam surface having a first portion with a first diameter and a second portion with a second diameter smaller than the first diameter, and a spring loaded, radially extending indexing pin movably attached to the anchorage and movable between an innermost position in which an innermost end of the indexing pin contacts the second portion of the indexing cam surface when the handle is rotated to an indexing position relative to the anchorage and an outermost position in which the innermost end of the indexing pin contacts the first portion of the indexing cam surface when the handle is rotated to a non-indexing position relative to the anchorage.

20. The weight apparatus as set forth in claim 1, comprising an indexing arrangement including an indexing cam surface attached to the handle, the indexing cam surface having a first portion with a first diameter and a second portion with a second diameter smaller than the first diameter, and a spring loaded, radially extending indexing pin movably attached to the anchorage and movable between an innermost position in which an innermost end of the indexing pin contacts the second portion of the indexing cam surface when the handle is rotated to an indexing position relative to the anchorage and an outermost position in which the innermost end of the indexing pin contacts the first portion of the indexing cam surface when the handle is rotated to a non-indexing position relative to the anchorage.

* * * * *